United States Patent [19]

Thomas, Jr.

[11] Patent Number: 4,883,190

[45] Date of Patent: Nov. 28, 1989

[54] THERMOPLASTIC BELLOWS LID FOR THERMOPLASTIC CONTAINERS

[75] Inventor: John S. Thomas, Jr., Williamsburg, Va.

[73] Assignee: Rampart Packaging, Inc., Williamsburg, Va.

[21] Appl. No.: 231,925

[22] Filed: Aug. 15, 1988

[51] Int. Cl.[4] ..... B65D 6/34

[52] U.S. Cl. ..... 220/66

[58] Field of Search ..... 220/66, 68, 70, DIG. 14; 215/1 C, 271

[56] References Cited

U.S. PATENT DOCUMENTS

| | | | |
|---|---|---|---|
| 2,971,671 | 2/1961 | Shakman | 220/66 |
| 3,057,537 | 10/1962 | Pollick | 220/66 X |
| 3,394,840 | 7/1968 | Pecci et al. | 220/68 |
| 3,400,853 | 9/1968 | Jacobsen | 220/66 |
| 3,437,254 | 4/1969 | Bergstrom | 220/70 X |
| 3,441,170 | 4/1969 | Khoury | 220/66 X |
| 4,381,061 | 4/1983 | Cerny et al. | 215/1 C |
| 4,458,469 | 7/1984 | Dunn | 220/66 X |
| 4,503,990 | 3/1985 | Roth et al. | 220/66 X |

FOREIGN PATENT DOCUMENTS

| | | | |
|---|---|---|---|
| 1119542 | 4/1956 | France | 220/66 |
| 2398669 | 7/1977 | France . | |
| 1367338 | 9/1974 | United Kingdom . | |
| 2133375 | 7/1984 | United Kingdom | 220/70 |

*Primary Examiner*—Stephen Marcus
*Assistant Examiner*—Nova Stucker
*Attorney, Agent, or Firm*—Donald F. Haas

[57] ABSTRACT

The invention is a thermoplastic lid which utilizes a bellows action to prevent paneling in the thermoplastic container to which it is attached. The lid comprises a flange for attachment to the container and a recessed center portion which has a flex area comprising a raised ridge adjacent to the outer ridge of the center portion. The stiffness of the lid and the thickness of the flex area are no greater than the maximum which will allow the center portion of the lid to flex inwardly sufficiently to provide the minimum displacement of head space necessary to prevent paneling.

9 Claims, 3 Drawing Sheets

FIG. 1
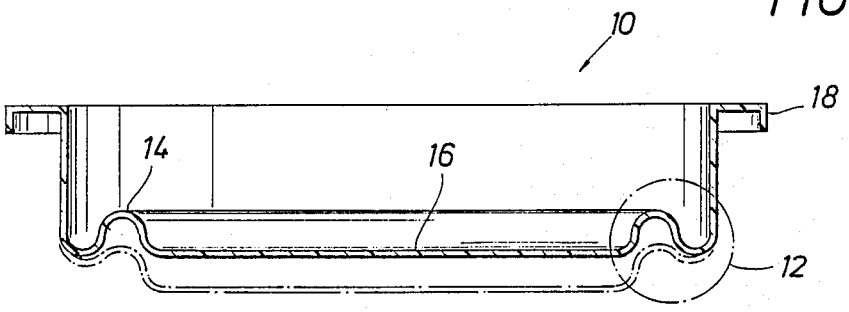
FIG. 2
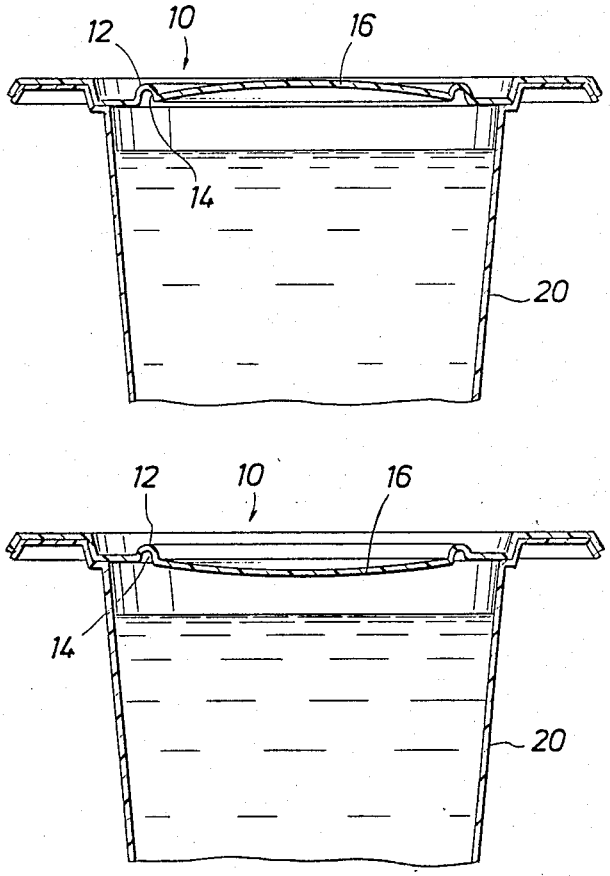
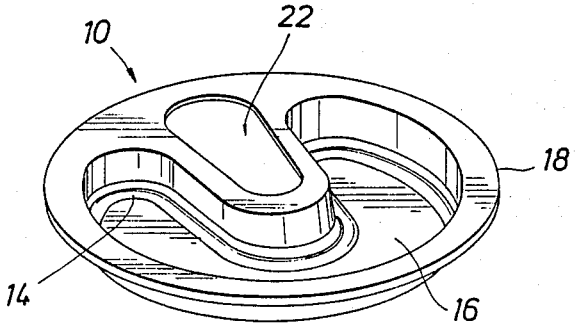
FIG. 3

THERMOPLASTIC BELLOWS LID FOR THERMOPLASTIC CONTAINERS

BACKGROUND OF THE INVENTION

This invention relates to a thermoplastic lid for thermoplastic containers. More particularly, the invention relates to a thermoplastic lid which is intended to be used as a closure for hot filled products.

It is known from U.K. Specification No. 1,367,338 to make cupped articles from a sheet of a thermoplastic material such as polypropylene. Such articles can also be made from billets of the same materials. The method comprises introducing a thin sheet or a billet of the thermoplastic material in the solid phase state, i.e. below the crystalline melting point, between a forming plug and a hollow mold having an end opening, moving the forming plug into the mold opening with the sheet to carry the stretched portion of the sheet into the mold, and introducing a pressure fluid into the stretched portion of the sheet to form the article in the mold. The above method is particularly suitable for making cupped articles of polypropylene and has met with considerable commercial success.

It is known that after filling and sealing a yieldable body such as a thermoplastic container made from such a cupped article, there is a tendency for the sidewalls thereof to deform or panel inwardly under certain conditions. This deformation of the sidewalls results from the pressure differential between the inside and the outside of the container and these deviations may be brought about by various physical or chemical conditions. In the packaging of food, various materials including fluids such as juices, syrups, salad oils and the like are oftentimes brought to elevated temperatures before introduction into thermoplastic containers. It has been found that there is a marked tendency for such containers to distort inwardly as described above. For example, when hot-filled containers are allowed to cool, the internal pressure will gradually decrease whereby the external atmospheric pressure causes their sidewalls to indent, panel or otherwise partially collapse. This condition renders the containers unacceptable to the ultimate consumer.

Aside from the problems associated with such hot-filled containers, there are other related packaging situations where chemical reactions cause noticeable reductions in the pressure differentials of the container resulting in the paneling or deformation of the sidewalls. For example, when lubrication or motor oil is packaged in a plastic container and sealed, chemical reactions take place between the various hydrocarbon constituents and any residual oxygen, e.g. air, causing the total pressure within the container to decrease. With this drop in pressure, there results an inward paneling of the sidewalls in order to equalize or compensate for the decrease in internal pressure. Here again, as with the hot-filled container, the containers are unacceptable to the ultimate consumer.

Aside from an undesirable appearance, the container itself loses column strength and sidewall symmetry which presents a problem in stacking them for storage, display and the like. Since the reduction in pressure cannot always be practically avoided, the present invention provides a container configuration wherein a portion of the lid of the container compensates or yields as more fully disclosed hereinafter in preference to the sidewalls of the container.

SUMMARY OF THE INVENTION

The invention relates to a thermoplastic lid for a thermoplastic container which is subject to paneling caused by the pressure differential which occurs when hot gases in the head space of the container condense upon cooling after hot filling. The lid comprises a flange for attachment to the container and a recessed center portion which has a flex area comprising a raised ridge adjacent to the outer edge of the center portion wherein the overall thickness of the lid is no less than the minimum thickness to allow an oxygen transmission rate of no more than 0.003 cubic centimeters per lid per day (if oxygen barrier properties are important for the use of the container) and the stiffness of the lid and the thickness of the flex area are no greater than the maximum which will allow the lid to flex inwardly to provide the minimum displacement of head space necessary to prevent paneling. For standard 3 inch diameter cups, it is preferred that the thickness of the flex area be no more than 6 mils and that the flexural modulus of the lid be no more than 180,000 psi. These parameters should allow a minimum displacement of head space of at least 6 ml at a pressure differential of 0.7 psi.

BRIEF DESCRIPTION OF THE DRAWINGS

FIG. 1 is a side view of the lid of the present invention which illustrates how the lid flexes to eliminate paneling.

FIG. 2 illustrates the position of the center portion of the lid both before and after cooling of the liquid within the container.

FIG. 3 illustrates a lid made according to the present invention which incorporates a spout.

DETAILED DESCRIPTION OF THE INVENTION

There are three major features of a lid that affect the lid's functionality as a closure for a thermoplastic container. These are sealability, oxygen barrier, if that is required for the application, and vacuum responsiveness, i.e. the lid's ability to eliminate paneling.

Sealability simply means that the materials of the lid are compatible with and can be sealed, preferably hermetically, to the thermoplastic container. In many applications today, such containers are made of polypropylene. Therefore, a preferred material for the outer layer of the lid is a propylene polymer such as a copolymer of propylene and ethylene because these copolymers have lower flexural modulus (130,000 psi) than homopolymer polypropylene (180,000 psi).

Many applications require that the container and the lid provide excellent oxygen barrier properties. For many shelf stable food products, the maximum amount of oxygen transmission which is permissible is 10 to 40 parts per million $O_2$ per year or 0.003 cubic centimeters per lid per day. Suitable oxygen barrier materials for use in the lid of the present invention include copolymers of ethylene and vinyl alcohol and polyvinylidiene chloride, among others.

As stated above, this invention relates to a thermoplastic lid which is intended to be used as a closure for containers which contain hot filled products such as juices. In one embodiment, the lid includes a pour spout which is raised above the level of recessed center portion and which has a sealable opening therein to allow access to the contents of the container. If this option is utilized, then less head space can be displaced because the recessed section of the container is smaller than if there were no spout.

The vacuum within the container is caused by the condensation of the hot gases in the head space after hot filling. Since the walls of the container are made of a relatively flexible thermoplastic, the vacuum within the container causes the sides of the container to buckle or pannel. Since the internal vacuum in the container is proportional to the head space volume, it can be seen that paneling can be reduced by decreasing head space.

In the present invention, the decrease in the amount of head space is accomplished in two ways. First, the center portion of the lid is recessed to reduce the internal head space. Additionally, a flex area is formed in the lid. This flex area in the lid is less resistant to the forces caused by the internal vacuum than are the sides of the container. Therefore, the flex area of the lid will be pulled inwardly to displace some of the head space in the container before the walls of the container will begin to panel.

Figure 6:
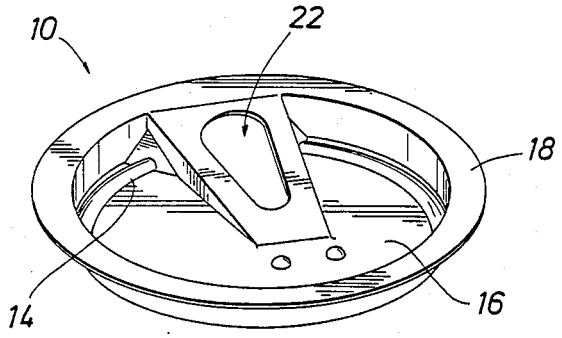
FIG. 6 illustrates a lid made according to the present invention which incorporates a different kind of a spout than that in FIG. 3.

The lid of the present invention deflects in response to pressure differential so as to eliminate container paneling. The mechanism by which the lid moves is a combination bellows and diaphragm formed into the lid. In FIG. 1, it is seen that the lid 10 has a flex area 12 which is comprised of a raised ridge 14 adjacent to the outer edge of the top or center portion 16 of the lid 10. The flex area 12 is thinner than the rest of the lid 10, preferably no more than 6 mils in thickness, so that it will be weak enough to allow the top 16 to be pulled inwardly by action of the vacuum within the container and the external pressure so as to displace a certain amount of the head space, preferably at least 6 milliters at an pressure differential of 0.7 psi. The dotted lines in FIG. 1 indicate how the top 16 of the lid 10 will flex away from the flange 18 of the lid 10 due to the action of the vacuum within the container. FIG. 2 shows a lid which is sealed onto a cup containing hot liquid and illustrates the positioning of the top 16 of the lid 10 while the liquid is still hot and then after the liquid has been cooled. It can be seen that the head space within the container after the liquid has cooled has been dramatically decreased. FIG. 3 illustrates a lid 10 which incorporates a pour spout 22. It can be seen that the ridge 14 extends around the outer edge of the top 16 of the lid 10 except at the spout 22 where it extends around the inside edge thereof. In one embodiment, as shown in FIG. 6, the ridge 14 ends at pout spout 22.

The bellows action is required herein even though the head space is reduced by recessing the top of the lid. Some head space must be provided within the container so that the liquid contents of the container do no spill prior to sealing. A container filled to the brim will spill over during transport to the seal area of a filling machine. The spillage will contaminate the seal area and destroy seal integrity. The bellows action of the lid of the present invention can, when designed properly, eliminate the paneling effects of the residual head space.

In order to eliminate paneling, there must be enough displacement of the head space of the container to reduce the internal vacuum such that the walls of the container will not panel. The amount of displacement attainable is proportional to the ability of the lid to flex inwardly. The flexing ability of the lid is related to the stiffness of the lid itself, which itself is related to the materials chosen and the thickness of the lid, as well as the thickness of the flex area. All of these factors must be combined properly to provide a lid which will provide sufficient displacement of the head space in the container to prevent paneling, preferably for standard 3 inch diameter cups, at least 6 milliliters of head space at a pressure differential of 0.7 psi. In applications which require oxygen barrier properties, all of these factors must be balanced against the requirement that there is a minimum thickness of the barrier material which will allow an oxygen transmission rate of no more than 10 to 40 parts per million $O_2$ per year or 0.003 cubic centimeters per lid per day, a requirement for many food applications, or some other minimum oxygen transmission rate for another type of application.

The specific numbers mentioned above relate to the standard size 3 inch diameter plastic cups which are in common use in industry today. Such containers generally have a wall thickness of no less than 0.011 inches. If the wall thickness is less than that, then the minimum displacement discussed above will be insufficient. If the wall thickness is 0.011 inches or more, then the lid of the present invention will function properly.

In general, a stiffer container needs less displacement and, in such cases, the flex area could be less flexible, i.e., thicker or made of a less flexible material. For the most part herein, the discussion relates to polypropylene polymer containers which utilize ethylene vinyl alcohol copolymers as a barrier layer. However, polystyrene containers which are comprised of laminates of polystyrene with ethylene vinyl alcohol copolymers and polyethylene may also be used. These laminates are softer than polypropylene because of the softer polyethylene. Thus, the flex area of the lid would have to be thinner to allow the displacement of more headspace at the same pressure. The overall flexural modulus would probably be less than that of the polypropylene laminate (210,000 psi). Also, polycarbonate laminates could be used. These are much stiffer than polypropylene (10 times). If such materials are used to make the container, then the flex area of the lid could be thicker and still function properly since in this situation less head space displacement is necessary. Also, a stiffer material than the random copolymers discussed herein could be used in the lid.

For random polypropylene copolymers used to make thermoplastic lids for 3 inch cups, the flex area of the lid should be no more than 6 mils. This is the maximum thickness which assures that the lid will deflect sufficiently to eliminate paneling in the container. If the flex area is any thicker, then it will be too stiff and paneling will occur.

Figure 7:
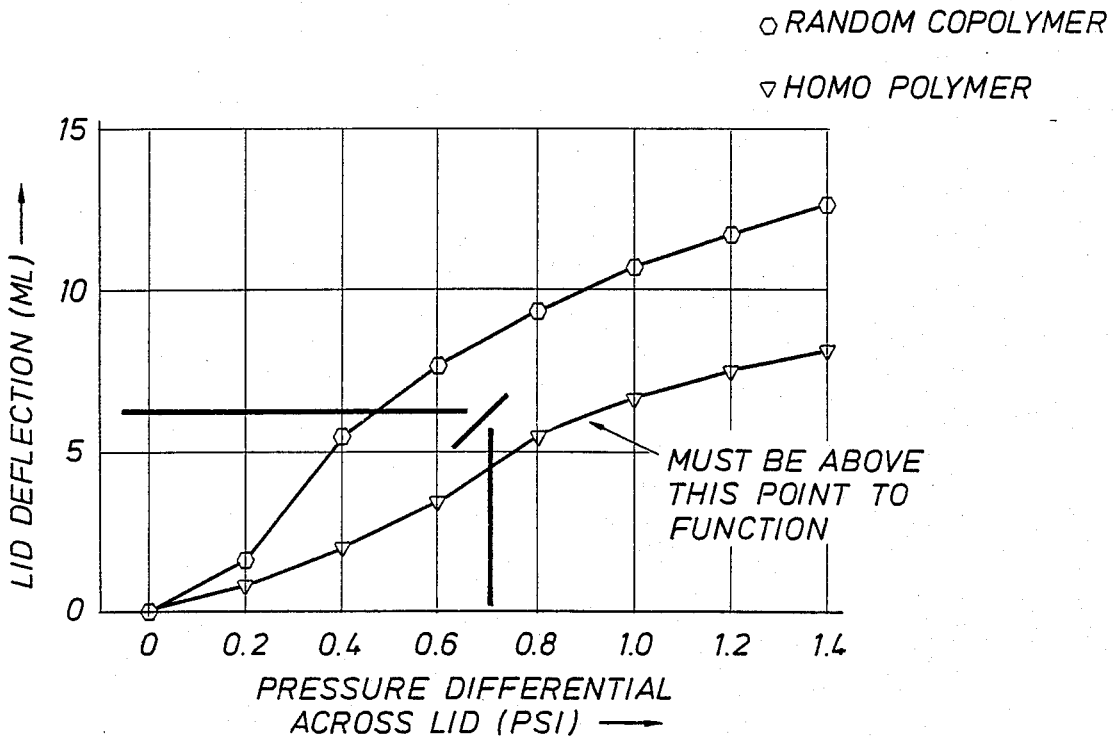
FIG. 7 is a graph of the lid deflection versus the pressure differential across the lid for lids made from two different polymers.

The material of the lid itself must not be too stiff or else the flex area will be insufficiently flexible to prevent paneling. Materials with a flex modulus of higher than 180,000 psi are too stiff and will allow containers to panel. In FIG. 7, it can be seen that the random copolymer allows sufficient lid deflection whereas the higher modulus homopolymer does not. Materials which are commonly used in barrier packaging applications are ethylene vinyl alcohol copolymers and polypropylene. The former may have a flexural modulus of around 280,000 psi and the latter around 210,000 psi which is also the approximate modulus of a polypropylene/ethylene vinyl alcohol copolymer/polypropylene laminate. Clearly, the combination of these two materials in a laminate would be too stiff for the present application. However, I have found that I can use ethylene vinyl alcohol copolymers in combination with copolymers of propylene and a minor amount of ethylene which have a flexural modulus in the range of 130,000 psi. When these materials are combined in a laminate, the flexural modulus of the overall laminate can be 180,000 psi or less, especially if the amount of the ethylene vinyl alcohol copolymers used in the laminate is from about 5% to about 20% by weight.

The overall thickness of the lid itself, excluding the flex area, is also a major consideration to achieve the advantages of the present invention. If the lid thickness is too great, then the lid will not be flexible enough to deflect inwardly to prevent paneling. Also, if the lid is too thin, it will be unacceptable in oxygen barrier applications.

Figure 4:
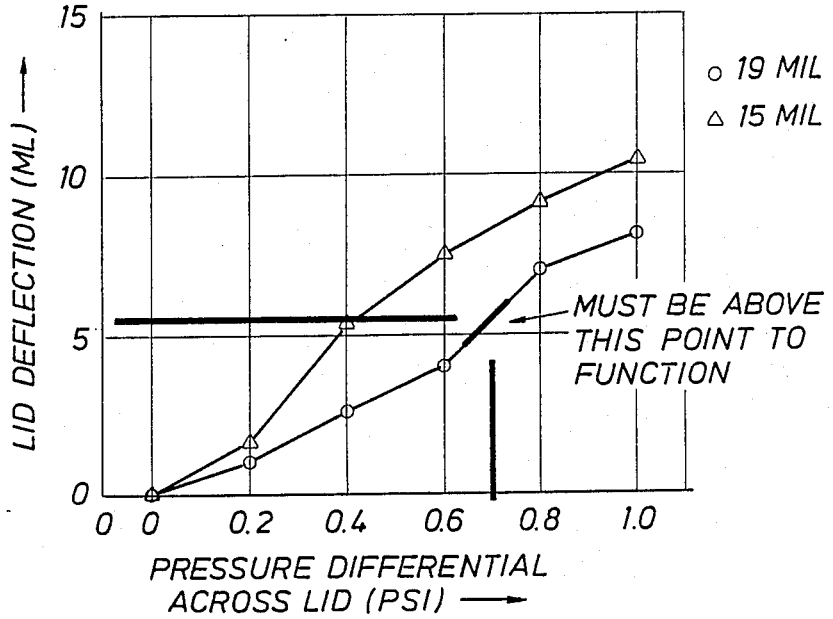
FIG. 4 is a graph of the lid deflection versus the pressure differential across the lid for two different sheet thicknesses.

The thickness of the lid is obviously related to the thickness of the sheet from which it is made. For example, if the thermoforming process described above is used, then the thickness of the sheet from which the lid is made can be no more than 19 mils. Referring to FIG. 4 where the lid deflection is plotted against the pressure differential across the lid for lids made from sheet 15 mils in thickness (the top line) and 19 mils in thickness (the bottom line), it can be seen that whereas the 15 mil sheet provides a lid with sufficient capacity for deflection, the 19 mil sheet is too thick. The minimum deflection is 6 milliliters of head space at a pressure differential of 0.7 psi and the 19 mil sheet gives marginal results. The conditions of a 6 milliliter deflection at 0.7 psi pressure differential are chosen because this is the worst case for commercial standard hotfill juice packaging.

The conditions of the tests which provided the results shown in FIG. 4 are as follows. The sheets are formed of a copolymer of propylene and about 2% ethylene (melt flow=2) on the outside and a layer of an ethylene vinyl alcohol copolymer on the inside wherein the ethylene vinyl alcohol copolymer comprises 10% of the total weight of the sheet. Lids were formed under similar conditions. For both the container and the lid, the polypropylene composition sheet was heated to its melting point and then clamped between a forming cavity and a hollow pressure box. Compressed air was applied to the hollow pressure box and traveled therethrough to stretch the sheet into the forming cavity. This forming process was used for both containers and lids. The lid deflection was measured by inducing a vacuum on the lid and measuring the displacement of the lid for a variety of pressure differentials.

Figure 5:
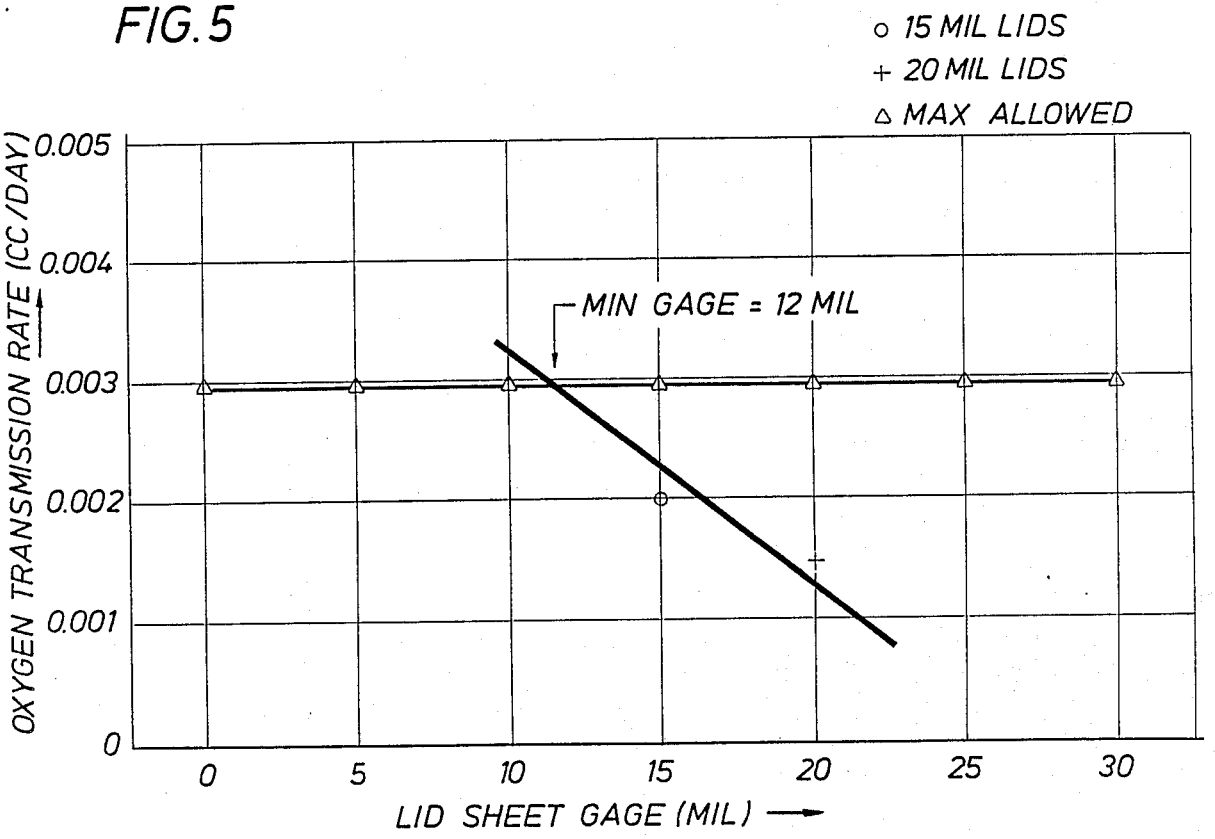
FIG. 5 is a graph of the oxygen transmission rate versus the thickness of the lid sheet.

FIG. 5 illustrates the determination of the minimum thickness of the sheet to provide a lid with an oxygen transmission rate of no more than 0.003 cubic centimeters per 100 sq. inches/day. The lids were formed as above and the oxygen transmission rate was measured on an oxygen transmission rate analyzer. It can be seen that lids formed from both 15 mil and 20 mil sheet provide excellent oxygen barrier whereas a 12 mil sheet provides the maximum acceptable oxygen transmission rate.

FIG. 7 illustrates the lid deflection at a variety of pressure differentials for two different polymers, a polypropylene homopolymer and a polypropylene random copolymer containing 2% ethylene as discussed above. Since the lid deflection must be at least 6 ml, it can be seen that polypropylene homopolymer is not functional but that the random copolymer definitely is functional in the present invention.

I claim:

1. A thermoplastic lid for a thermoplastic container which is subject to paneling caused by the pressure differential which occurs when hot gases in head space of the container condense upon cooling after hot filling, which comprises a flange for attachment to the container and a recessed center portion which has a flex area which is thinner than the rest of the lid and comprises a raised ridge adjacent to the outer edge of the center portion, wherein the stiffness of the lid and the thickness of the flex area are no greater than the maximum which will allow the top of the lid to flex inwardly to provide the minimum displacement of head space necessary to prevent paneling.

2. The lid of claim 1 wherein the thickness of the flex area is no more than 6 mils and the flexural modulus of the lid is no more than 180,000 psi.

3. The lid of claim 1 wherein the lid also includes a pour spout which is raised above the level of the recessed center portion and which has a sealable opening therein to allow access to the contents of the container.

4. A thermoplastic lid for a thermoplastic container which is subject to paneling caused by the pressure differential which occurs when hot gases in head space of the container condense upon cooling after hot filling, which comprises a flange for attachment to the container and a recessed center portion which has a flex area which is thinner than the rest of the lid and comprises a raised ridge adjacent to the outer edge of the center portion, wherein the stiffness of the lid and the thickness of the flex area are no greater than the maximum which will allow the top of the lid to flex inwardly sufficiently to displace 6 milliliters of head space at a pressure differential of 0.7 psi.

5. The lid of claim 4 wherein the thickness of the flex area is no more than 6 mils and the flexural modulus of the lid is no more than 180,000 psi.

6. The lid of claim 4 wherein the lid also includes a pour spout which is raised above the level of the recessed center portion and which has a sealable opening therein to allow access to the contents of the container.

7. A thermoplastic lid for a thermoplastic container which is subject to paneling caused by the pressure differential which occurs when hot gases in head space of the container condense upon cooling after hot filling, which comprises a flange for attachment to the container and a recessed center portion which has a flex area which is thinner than the rest of the lid and comprises a raised ridge adjacent to the outer edge of the center portion, wherein the lid has an inner layer of an oxygen barrier material and outer layers of a thermoplastic with a flexural modulus of no more than 130,000 psi, the flexural modulus of the lid is no more than about 180,000 psi and the thickness of the flex area is no more than about 6 mils such that the top of the lid will flex inwardly to displace at least 6 m illiliters of head space at a pressure differential of 0.7 psi.

8. The lid of claim 7 wherein the oxygen barrier material is selected from the group consisting of ethylene vinyl alcohol copolymers and polyvinylidiene chloride and the thermoplastic is selected from the group consisting of copolymers of propylene with a minor amount of ethylene.

9. The lid of claim 7 wherein the lid also includes a pour spout which is raised above the level of the recessed center portion and which has a sealable opening therein to allow access to the contents of the container.

* * * * *